United States Patent [19]

White

[11] 4,437,795

[45] Mar. 20, 1984

[54] MINE ROOF ANCHOR ASSEMBLY

[75] Inventor: Claude C. White, Birmingham, Ala.

[73] Assignee: Birmingham Bolt Company, Birmingham, Ala.

[21] Appl. No.: 317,490

[22] Filed: Nov. 2, 1981

[51] Int. Cl.[3] ..... E21D 21/00; E21D 20/02

[52] U.S. Cl. ..... 405/259; 405/261; 411/47

[58] Field of Search ..... 405/259–261; 411/45, 47, 57, 60

[56] References Cited

U.S. PATENT DOCUMENTS

| | | | |
|---|---|---|---|
| 2,952,129 | 9/1960 | Dempsey | 405/261 |
| 3,940,941 | 3/1976 | Libert et al. | 405/261 |
| 4,100,748 | 7/1978 | Hansen | 411/47 X |
| 4,293,244 | 10/1981 | Donan, Jr. | 405/259 |
| 4,299,515 | 11/1981 | Yates et al. | 411/45 X |

*Primary Examiner*—Cornelius J. Husar
*Assistant Examiner*—Nancy J. Stodola
*Attorney, Agent, or Firm*—Shlesinger, Arkwright, Garvey & Fado

[57] ABSTRACT

A mine roof anchor assembly comprising an elongated bolt, one end of which is threadedly engaged with an expansion anchor. The expansion anchor includes a cone nut threaded on the bolt which moves axially through a shell for expanding the latter into gripping engagement with the mine roof. A bail member of inverted L-shape is connected to, and extends upwardly from, the expansion shell, a portion of the bail member overlying the cone nut to limit the relative longitudinal movement of the bolt when it is rotated in the cone nut. That portion of the bail member overlying the bolt is deflected by the latter to urge teeth mounted on the bail member portion into impinging engagement with the mine roof.

10 Claims, 5 Drawing Figures

MINE ROOF ANCHOR ASSEMBLY

BACKGROUND OF THE INVENTION

This invention relates to the securing of anchor bolts in drilled openings in a mine roof in order to support the latter.

For many years, mine roof anchors of the expansion shell type have been widely used for supporting mine roofs. These anchors generally include a wedge member or nut which is threadedly engaged with the upper end of the bolt and shell segments which surround the bolt are connected by an inverted U-shape bail member, the ends of which are secured to diametrically opposed portions of the shell segments. The intermediate portion of the U-shape bail member engages the wedge member and prevents relative rotation thereof, the intermediate portion also lying within the path of the bolt to limit the longitudinal movement thereof relative to the expansion shell. Therefore, upon rotation of the bolt, the threaded engagement of the bolt and wedge member causes the latter to move longitudinally of the bolt and axially through the expansion shell, thereby causing the shell segments to expand into gripping engagement with the mine roof.

It is essential to the installation of the conventional mine roof bolt assembly that the expansion shell, bail member and wedge member remain stationary when the bolt is rotated, and this necessitates frictional engagement of the expansion shell with that portion of the mine roof defining the mine roof opening. However, in some instances, slippage occurs resulting in at least some rotational movement of the expansion shell, bail member and wedge member, thereby prolonging the installation of the mine roof anchor assembly.

SUMMARY OF THE INVENTION

The mine roof anchor assembly of the present invention includes an elongated bolt having a head at one end and threaded at the other end for threaded engagement with a cone or wedge nut. An expansion shell comprising shell segments having wall-engaging ribs on the outer surface thereof and a tapered inner surface for sliding engagement with the outer wall of the cone nut, is mounted on the threaded end of the bolt, the shell segments being connected together at the lower end, and provided with a generally inverted L-shape bail member, a portion of which extends upwardly from the shell, and a second portion of which extends inwardly of the shell and overlies the cone nut in the path of movement of the elongated bolt to limit the longitudinal movement thereof.

A pair of teeth are mounted in angular relation to each other on the overlying portion of the bail member and, upon rotation of the bolt in the cone nut, the inverted L-shaped bail member is deflected in a direction to force the teeth into impinging engagement with the mine roof. This positively prevents rotation of the bail member, the expansion shell and cone nut connected thereto. The teeth further provide additional securing means, in conjunction with the wall-engaging ribs of the shell segments, for grippingly engaging the mine roof wall.

DESCRIPTION OF THE INVENTION

Figure 1:
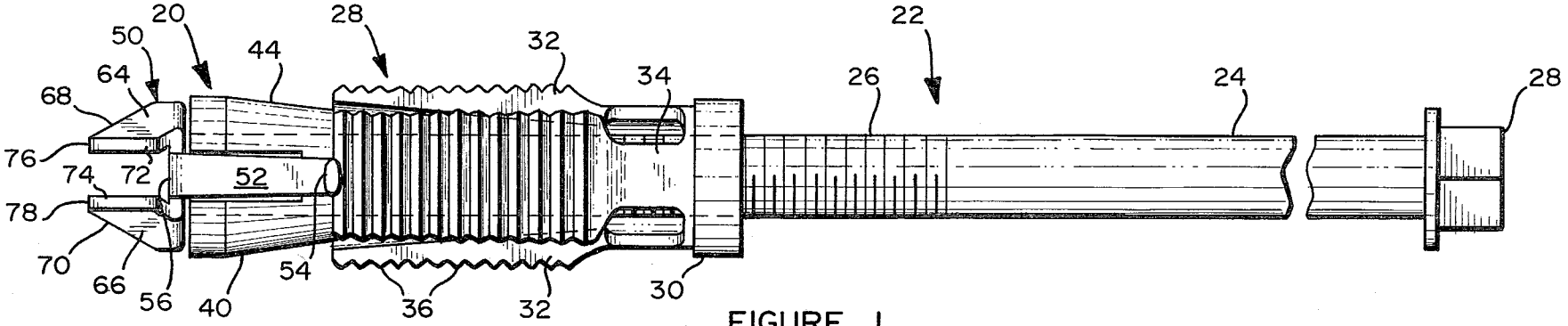
FIG. 1 is a fragmentary front elevational view of the anchor assembly of the present invention.

The mine roof anchor assembly of the present invention generally includes an expansion anchor 20 which is mounted on an elongated bolt 22, the bolt comprising a shank 24 which is threaded at one end as indicated at 26, and provided with a head 28 at the other end.

Expansion anchor 20 includes a lower collar or ring 30 which surrounds the threaded end 26 of shank 24, and a plurality of like, shell segments 32 which are connected to collar 30 by reduced neck portions 34. Shell segments 32 are slightly spaced apart and are of arcuate conformation in cross section. The outer surface of each shell segment is provided with a series of transverse ribs 36 adapted for gripping engagement with the mine roof wall when the expansion shell is actuated. As shown to advantage in FIG. 2, the inner surface of each shell segment 32 is inwardly tapered from top to bottom as shown at 38.

Expansion anchor 20 further includes a cone or wedge nut 40 having an axial threaded bore 42 for threaded engagement with threaded shank portion 26. The outer surface of cone nut 40 is tapered inwardly from top to bottom as indicated at 44 for sliding engagement with the tapered wall 38 of shell segments 32. Diametrically opposite side edges of cone nut 42 are cut away to provide longitudinal grooves 46 and 48 for purposes which will hereinafter be more fully set out.

In accordance with the present invention, there is also provided an inverted L-shaped bail member generally designated 50 which extends upwardly from expansion shell 28. Bail member 50 includes a substantially vertical leg 52, the lower end of which is secured in any suitable manner to the upper edge of a wedge segment 32 as indicated at 54, a substantial portion of the leg lying within longitudinal groove 46 of cone nut 40.

The upper terminal of leg 52 is bent at substantially a right angle as indicated at 56 at which point the inwardly directed portion is enlarged to provide a flat base 58 of generally pentagonal shape. Base 58 overlies the axial bore 42 of cone nut 40 and serves as a shield to prevent the entry of foreign material into the threaded bore. Base 58 also serves as a stop member against which the upper end of threaded bolt part 26 abuts upon installation of the assembly in a mine roof opening.

Figure 3:
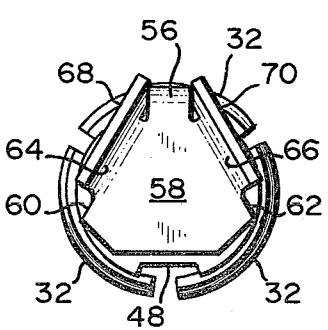
FIG. 3 is a top plan view of the present anchor assembly.

It will be noted from FIG. 3 of the drawing that two of the opposed sides of the base 58, designated 60 and 62, lie in angularly spaced relation and are provided with outwardly directed extensions in the form of teeth 64 and 66. Teeth 64 and 66 are of generally flat, polygonal shape and include upper edges 68 and 70 which extend upwardly and outwardly, and intersect with substantially vertical edges 72 and 74 to form sharp, wall-engaging points 76 and 78 which lie at a point proximate the peripheral limit of the assembly.

When used in conjunction with a resin cartridge for anchoring the assembly in place, upwardly inclined edges 68 and 70 also serve to engage and push the resin cartridge to one side of the opening preparatory to slitting the same when the assembly is inserted into the mine roof opening.

Figure 2:
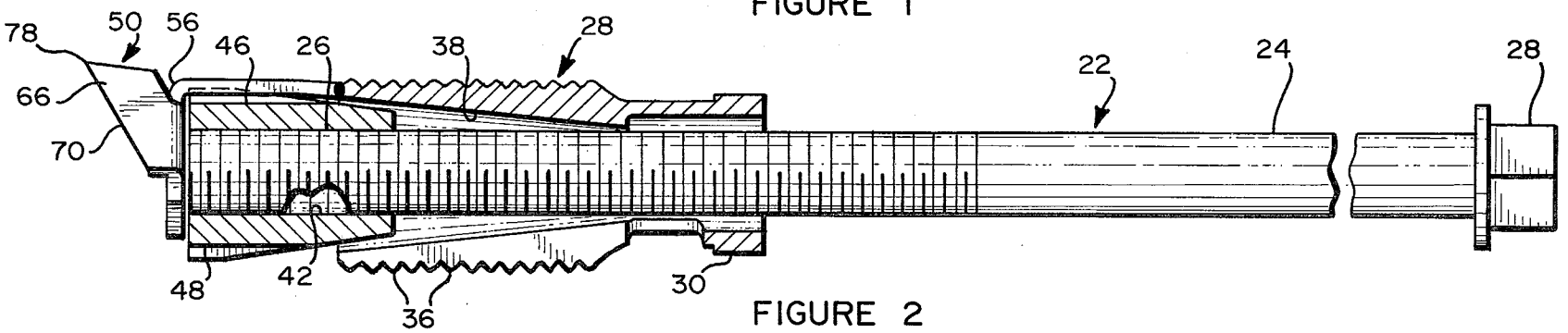
FIG. 2 is a fragmentary side elevational view of the present anchor assembly, a portion thereof being shown in section.

In the initial position of use of the anchor assembly of the present invention in a mine roof opening, the component parts of the assembly are positioned as shown in FIGS. 1 and 2 with the upper end of threaded part 26 in contiguous relation with base 58 of bail member 50, and with the lower end of cone nut 40 threaded on the threaded part 26 of bolt 22, while the upper end thereof is in proximate relation to base 58 of bail member 50.

Figure 5:
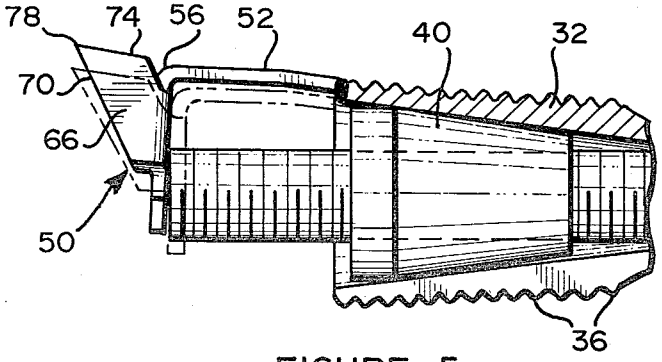
FIG. 5 is a side elevational view of the upper portion of the anchor assembly of the present invention, showing the bail member in deflected position.
Figure 4:
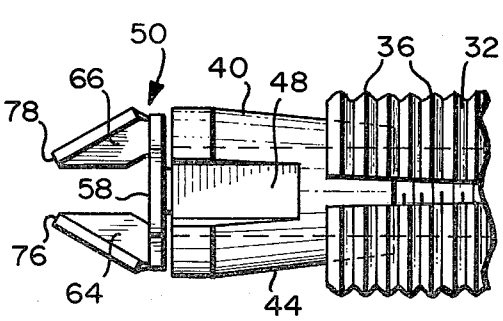
FIG. 4 is a rear elevational view of the upper portion of the anchor assembly.

As bolt 22 is rotated through cone nut 40, the force of the end of threaded shank 26 against base 58 of bail member 50 causes the bail member to be deflected slightly, as shown to advantage in FIG. 5, thereby relocating teeth 64 and 66 so that points 76 and 78 extend beyond the peripheral limit of the assembly into impinging engagement with the mine roof. This prevents rotational movement of bail member 50 and shell segments 38 and cone nut 40 connected thereto.

Continued rotation of bolt 22 results in cone nut 40 moving downwardly on threaded bolt part 26 between shell segments 32. As shown in FIGS. 2 and 3, the engagement of tapered outer wall 44 of cone nut 40 with tapered inner walls 38 of wedge segments 32, forces the latter outwardly until ribs 36 of the shell segments are in gripping engagement with the mine roof to secure the expansion anchor and roof bolt in position.

Teeth 64 and 66 of bail member 50, therefore, serve to initially engage the mine roof wall to hold the expansion anchor in stationary position while bolt 22 is rotated, and then functions as a securing means in addition to shell segment ribs 36, for holding the mine roof anchor assembly in supporting engagement with the mine roof.

The anchor assembly of the present invention affords simple and economic means for installing and securing the assembly in position in a mine roof opening, which includes positive means for facilitating the installation of the assembly and for minimizing chances of failure thereof after installation.

Although there has been herein shown and described the presently preferred form of this invention, it is to be understood that various changes may be made therein within the scope of the appended claims.

What is claimed is:

1. A mine roof anchor assembly including (a) an elongated bolt having a head at one end and threaded for a portion of its length at the other end (b) an expansion anchor mounted on the threaded end of said bolt (c) said expansion anchor including a wedge member threadedly engaged with the threaded end of said bolt, and an expansion member through which said wedge member passes to urge said expansion member into gripping engagement with the mine roof (d) said expansion anchor further including a bail member secured to one end of said expansion member (e) said bail member including a first upwardly extending portion and a second portion extending inwardly from the upper end of said first portion and in overlying relation to said wedge member, to limit the upward movement of said elongated bolt relative to said expansion member, and (f) mine roof-engaging means carried by the inwardly extending second portion of said bail member (g) said mine roof-engaging means and bail member being deflected in a direction to urge the former into impinging engagement with the mine roof under force of said elongated bolt engaging the inwardly extending second portion of said bail member.

2. The mine roof anchor assembly of claim 1, wherein (a) said bail member is of substantially inverted L-shape.

3. The mine roof anchor assembly of claim 1, wherein (a) said mine roof-engaging means comprises a tooth extending upwardly from said second portion of the bail member.

4. The mine roof anchor assembly of claim 3, wherein (a) said tooth includes an upwardly inclined portion and a substantially vertical portion which converge to form a point, which point impinges the mine roof upon deflection of the bail member and tooth.

5. The mine roof anchor assembly of claim 4, with the addition of (a) a second mine roof-engaging tooth mounted on said second portion of the bail member in spaced angular relation to said first mine roof-engaging means (b) said second tooth being similar to said first tooth and including an upwardly inclined portion and a substantially vertical portion which converge to form a second point, which second point impinges the mine roof upon deflection of the bail member and said first and second teeth.

6. The mine roof anchor assembly of claim 1, wherein (a) said second portion of the bail member comprises a flat body overlying said wedge member, to prevent foreign material from entering said wedge member.

7. A mine roof anchor assembly including (a) an elongated bolt having a head at one end and threaded for a portion of its length at the other end (b) an expansion anchor including a nut having a tapered outer wall, said nut being threadedly engaged with the threaded end of said bolt, and an expansion shell having a tapered inner wall engaged by the tapered outer wall of said nut to expand said expansion shell when said nut passes axially therethrough, to urge the expansion shell into gripping engagement with the mine roof (c) said expansion anchor further including a bail member of substantially inverted L-shape, and comprising a first portion secured at one end to said expansion shell and extending upwardly therefrom, and a second portion extending from the upper end of said first portion into overlying relation with said expansion anchor nut to limit the longitudinal movement of said elongated bolt relative to said expansion anchor, and (d) a tooth extending upwardly from the inwardly extending second portion of said bail member (e) said tooth and bail member being deflected in a direction to urge the former into impinging engagement with the mine roof under force of said elongated bolt engaging the inwardly extending second portion of said bail member.

8. The mine roof anchor assembly of claim 7, wherein (a) said tooth comprises an upwardly inclined portion and a substantially vertical portion which converge to form a point, which point is urged into impinging engagement with the mine roof upon deflection of said bail member and tooth.

9. The mine roof anchor assembly of claim 8, with the addition of (a) a second tooth mounted on said second portion of the bail member in spaced angular relation to said first mine roof-engaging means (b) said second tooth being similar to said first tooth and including an upwardly inclined portion and a substantially vertical portion which converge to form a second point, which second point impinges the mine roof upon deflection of the bail member and said first and second teeth.

10. The mine roof anchor assembly of claim 7, wherein (a) said second portion of the bail member comprises a flat body overlying said wedge member to prevent foreign material from entering said wedge member.

* * * * *